US006162033A

United States Patent [19]

Moore, Jr. et al.

[11] Patent Number: 6,162,033

[45] Date of Patent: Dec. 19, 2000

[54] COMPRESSOR ECONOMIZER TUBE ASSEMBLY

[75] Inventors: Billy W. Moore, Jr., Hot Springs; Scott Westberg; Frederick L. Phillips, both of Arkadelphia, all of Ark.

[73] Assignee: Carrier Corporation, Syracuse, N.Y.

[21] Appl. No.: 09/121,384

[22] Filed: Jul. 23, 1998

[51] Int. Cl.[7] ..... F04C 18/00

[52] U.S. Cl. ..... 418/55.1; 418/270; 418/248; 417/902

[58] Field of Search ..... 418/55.1, 248; 417/270, 902

[56] References Cited

U.S. PATENT DOCUMENTS

| | | | |
|---|---|---|---|
| 2,629,544 | 2/1953 | Ohmart | 417/902 |
| 3,870,440 | 3/1975 | Zuercher, Jr. | 418/248 |
| 3,871,800 | 3/1975 | Slaton | 418/248 |
| 3,902,629 | 9/1975 | Kushner | 417/902 |
| 4,406,594 | 9/1983 | Smaby et al. | 417/902 |
| 4,606,706 | 8/1986 | Utter | 417/902 |
| 4,811,471 | 3/1989 | Etemad et al. | 418/55.1 |
| 5,007,807 | 4/1991 | Gannaway | 417/902 |

*Primary Examiner*—Thomas Denion
*Assistant Examiner*—Thai-Ba Trieu
*Attorney, Agent, or Firm*—Carlson, Gaskey & Olds

[57] ABSTRACT

The present invention comprises an economizer tube assembly for a sealed compressor. The economizer tube assembly of the present invention includes an economizer fitting and an economizer fitting extension. The economizer fitting extension extends through a center shell assembly of the compressor into a housing element that defines a portion of the compression chamber. The economizer fitting extension includes a refrigerant vapor seal with the housing element. The economizer fitting and economizer fitting extension both include interior chambers, which are in communication with each other. The economizer fitting mounts flush to the center shell assembly and is preferably secured to the center shell assembly by a welded joint.

18 Claims, 3 Drawing Sheets

COMPRESSOR ECONOMIZER TUBE ASSEMBLY

BACKGROUND OF THE INVENTION

This invention relates generally to sealed compressors and, more particularly, to an economizer tube assembly for a sealed compressor.

A typical compressor is comprised of several compartments including a compression chamber. The compartments of the compressor are surrounded by an outer shell. Proper functioning of a compressor requires that the compartments of the compressor remained sealed from each other and from the environment. To increase the efficiency of a cooling cycle many compressors incorporate an economizer cycle as a part of the cooling cycle. As part of the economizer cycle, a portion of a refrigerant is injected into the compression chamber through an economizer tube.

Incorporation of an economizer tube must not destroy the integrity of the sealed compartments of the compressor. Thus, it is necessary to have a refrigerant vapor seal between the economizer tube and the compressor housing. In addition, it would be advantageous to design an economizer tube assembly that helps align the compression chamber within a compressor relative to the outer shell of the compressor.

SUMMARY OF THE INVENTION

In general terms, the present invention provides a tube assembly that not only serves as a mechanism for alignment of a compression chamber relative to the outer shell of the compressor, but in addition maintains the integrity of the compression chamber and is easily mounted to the outer shell of the compressor.

A preferred embodiment of the present invention includes a sealed compressor having a shell assembly and a housing element. An economizer tube assembly includes an economizer fitting connected to an economizer fitting extension. Both the economizer fitting and economizer fitting extension have an interior chamber, and the interior chambers are in communication with each other. The economizer fitting is secured to the center shell assembly and the economizer fitting extension extends into the center shell assembly. The economizer fitting extension forms a refrigerant vapor seal with the housing element of the compressor. In a most preferred embodiment, the compressor comprises a scroll compressor and the housing element comprises a non-orbiting scroll.

These and other features and advantages of this invention will become more apparent to those skilled in the art from the following detailed description of the presently preferred embodiment. The drawings that accompany the detailed description can be described as follows.

DETAILED DESCRIPTION OF THE PREFERRED EMBODIMENT

Figure 1:
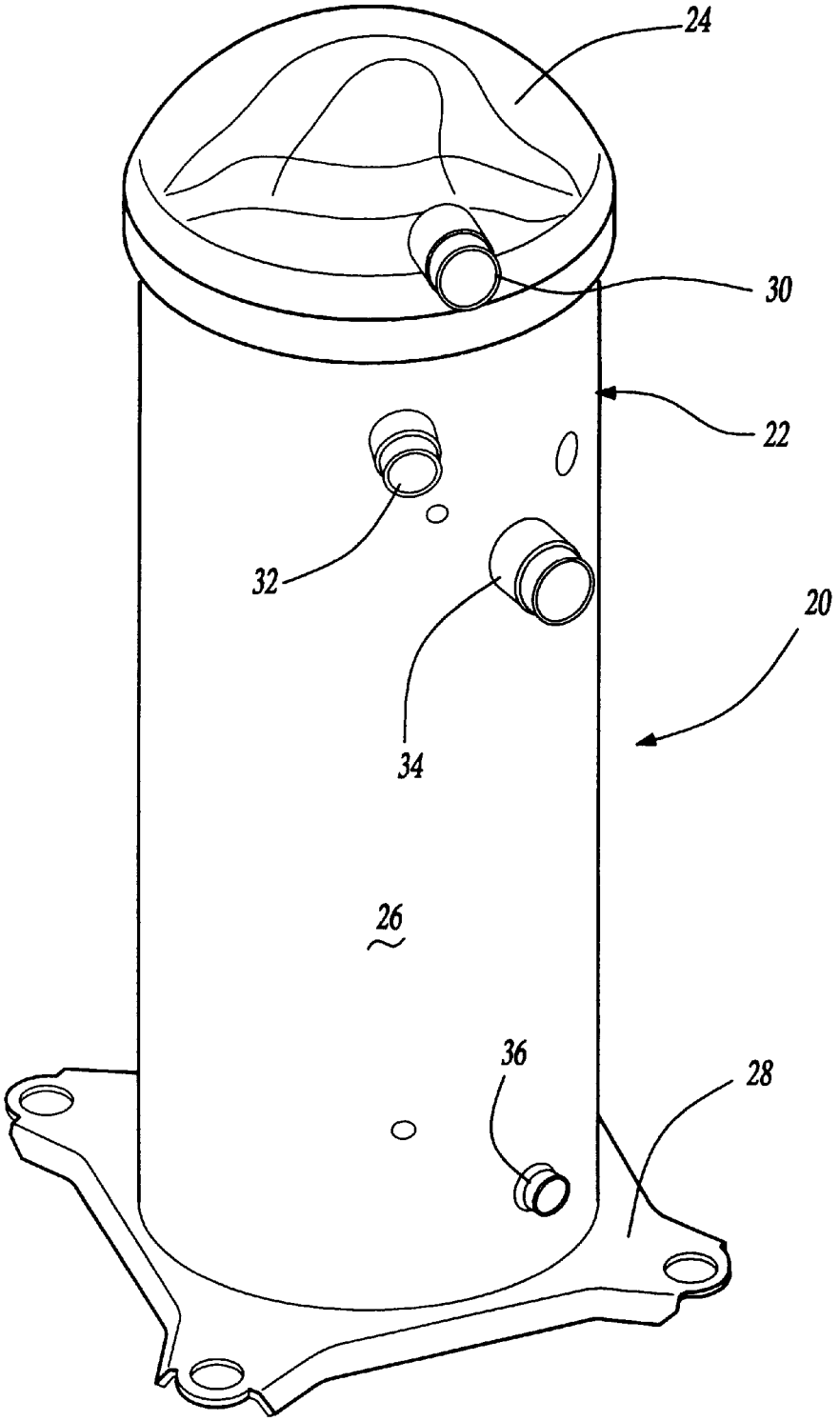
FIG. 1 is a perspective view of a compressor designed according to the present invention.

A compressor is generally indicated at 20 in FIG. 1. Compressor 20 generally includes an outer shell assembly 22 comprised of an upper shell assembly 24, a center shell assembly 26, and a lower shell assembly 28. Upper shell assembly 24 includes a discharge fitting 30. Center shell assembly 26 includes an economizer fitting 32, a suction fitting 34, and an oil drain fitting 36. In the following description compressor 20 will be described as a scroll compressor, as will be understand by one having ordinary skill in the art, compressor 20 may comprise any other known sealed compressor.

Figure 3:
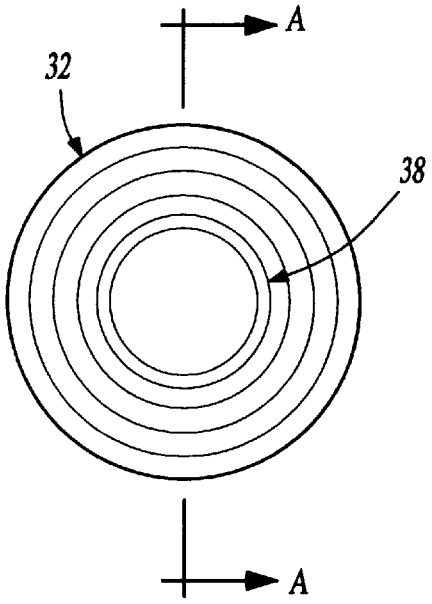
FIG. 3 is an end view of FIG. 2.
Figure 2:
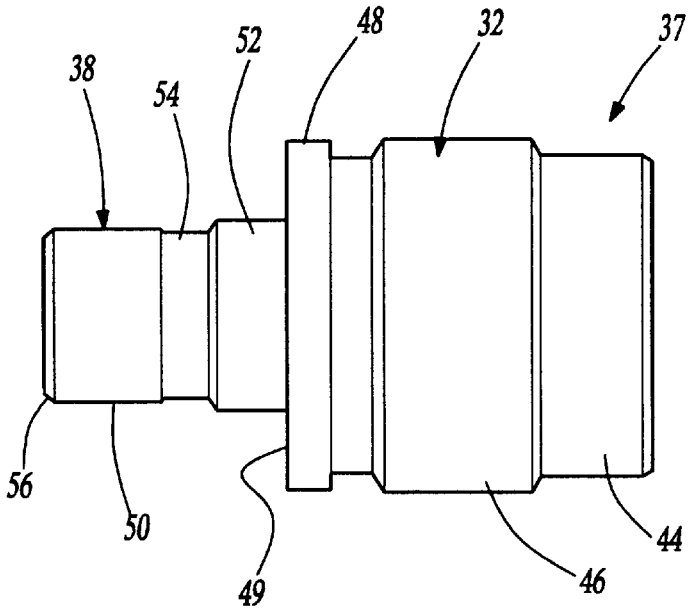
FIG. 2 is a side view of an economizer tube assembly designed according to the present invention.

An economizer tube assembly is generally shown at 37 in FIG. 2. Economizer tube assembly 37 includes economizer fitting 32, which is connected to an economizer fitting extension 38. Economizer fitting 32 includes an exterior surface 44 having a raised band 46 and a flange 48. Flange 48 includes a first surface 49. Economizer fitting extension 38 includes an exterior surface 50 having a raised band 52, a groove 54, and a first beveled end 56. FIG. 3 is an end view of economizer tube assembly 37 as shown in FIG. 2.

Figure 4:
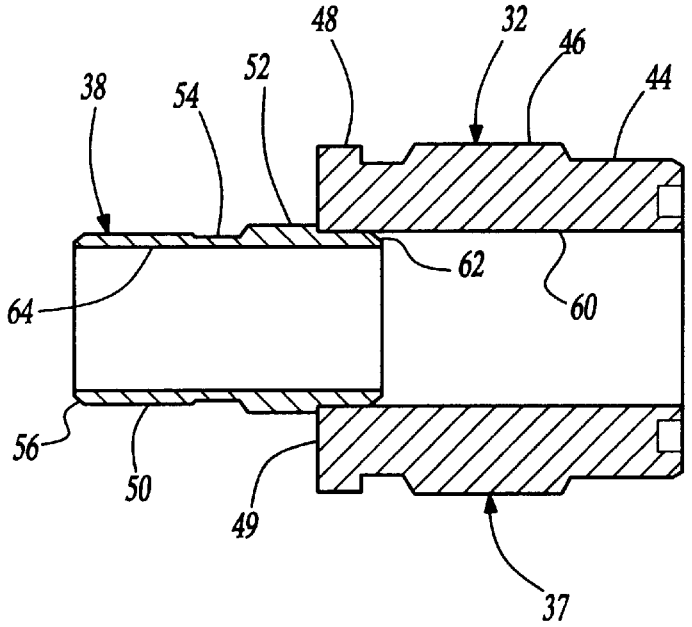
FIG. 4 is a cross-sectional view along line A—A of FIG. 3.

FIG. 4 is a cross-sectional view along line A—A of FIG. 3. Economizer fitting 32 includes an interior chamber 60. Economizer fitting extension 38 includes a second beveled end 62 opposite first beveled end 56. Economizer fitting extension 38 also includes an interior chamber 64. Interior chamber 60 is in communication with interior chamber 64.

Preferably, economizer fitting 32 includes a fitting on the end opposite economizer fitting extension 38, as is known in the art. Preferably, economizer fitting extension 38 fits inside interior chamber 60 and an interference fit between economizer fitting extension 38 and economizer fitting 32 connects them together. Second beveled end 62 aids the insertion of economizer fitting extension 38 into economizer fitting 32. When economizer fitting extension 38 is inserted into economizer fitting 32, raised band 52 is flush against first surface 49. An approximately ninety degree angle is created between raised band 52 and first surface 49. It is also preferable that raised band 46 of economizer fitting 32 include a set of internal threads for connection to other parts of a compression system (not shown).

Figure 5:
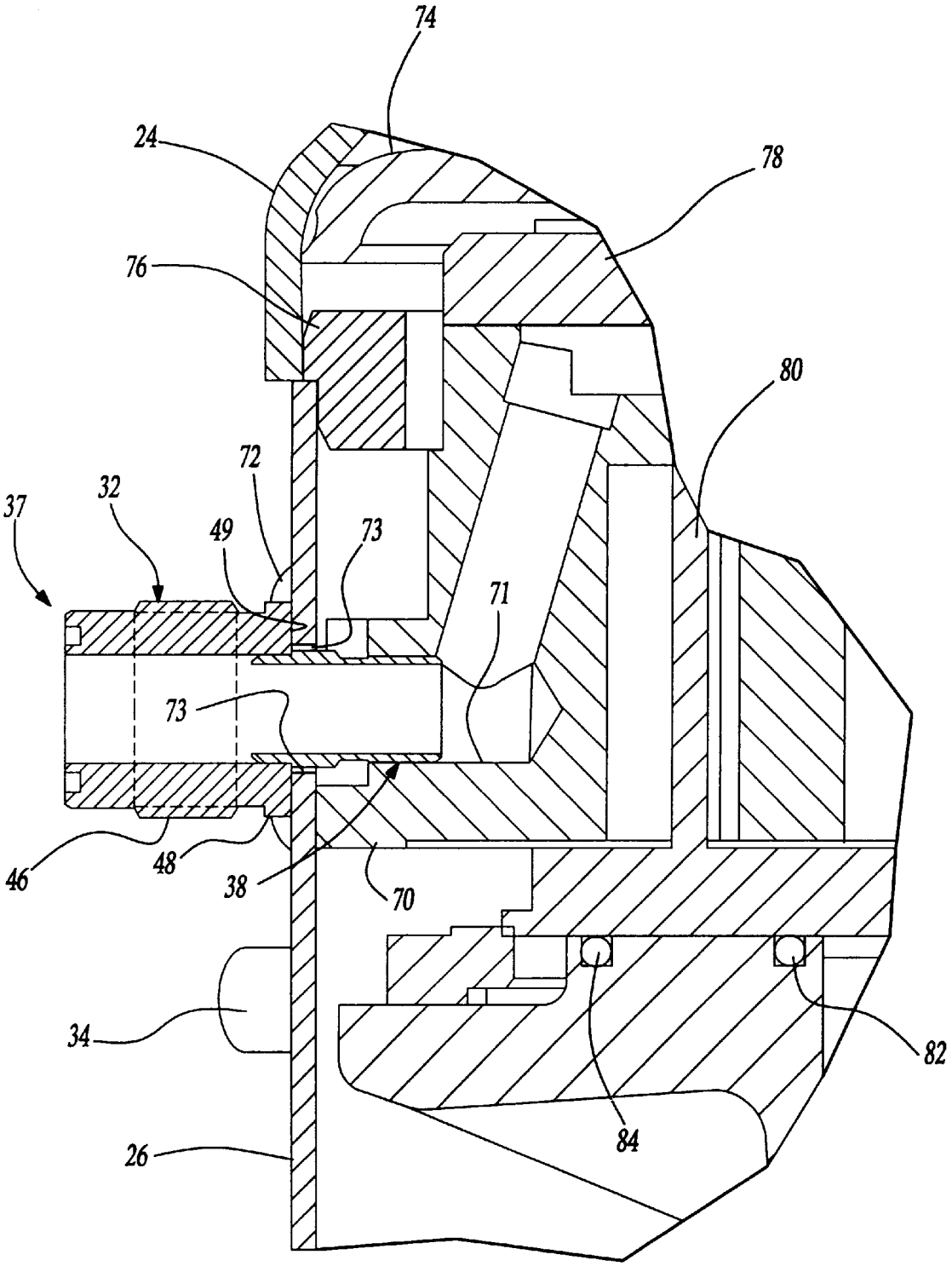
FIG. 5 is a partial cross-sectional view of the compressor incorporating the tube assembly.

FIG. 5 is a partial cross-sectional view of compressor 20 incorporating economizer tube assembly 37. As discussed above, compressor 20 will be described as a scroll compressor, as will be understood by one of ordinary skill in the art compressor 20 may comprise any other sealed compressor. As shown in FIG. 5, economizer fitting extension 38 extends into center shell assembly 26. Economizer fitting extension also extends into and is connected to a housing element 70. The housing element 70 defines a portion of a compression chamber. In FIG. 5 housing element 70 comprises a non-orbiting scroll since compressor 20 is a scroll compressor. Housing element 70 includes an aperture 71 for accommodating economizer fitting extension 38. The diameter of aperture 71 is designed to create an interference fit between economizer fitting extension 38 and aperture 71. This interference fit creates a refrigerant vapor seal between economizer fitting extension 38 and housing element 70.

First beveled end 56 aids in inserting economizer fitting extension 38 into housing element 70. When economizer fitting extension 38 is inserted into housing element 70, a gap 73 exists between raised band 52 of economizer fitting extension 38 and center shell assembly 26. Gap 73 aids in aligning housing element 70 within compressor 20 and with economizer tube assembly 37. The reliable seals at weld 72 and extension 38, allow the use of gap 73.

Economizer fitting 32 is secured to center shell assembly 26 by a welded joint 72. First surface 49 mounts flush to center shell assembly 26. Thus, welded joint 72 seals economizer tube assembly 37 to center shell assembly 26.

Compressor 20 further includes a separator plate assembly 74, a weld ring 76, and a discharge cover 78. Compressor 20 also includes an orbiting scroll 80 adjacent an inner seal 82 and an outer seal 84. As noted above, preferably housing element 70 comprises a non-orbiting scroll when compressor 20 is a scroll compressor. In a sealed compressor other than a scroll compressor, housing element 70 would define a portion of the compressor's compression chamber.

The present invention has been described in accordance with the relevant legal standards, thus the foregoing description is exemplary rather than limiting in nature. Variations and modifications to the disclosed embodiment may become apparent to those skilled in the art and do come within the scope of this invention. Accordingly, the scope of legal protection afforded this invention can only be determined by studying the following claims.

We claim:

1. A compressor comprising:

a sealed compressor having a shell assembly and a housing element;

a tube assembly including a fitting connected to a fitting extension, each of said fitting and said fitting extension having an interior chamber;

said interior chambers in communication with each other, such that a fluid flowing into one of said chambers can pass into the other of said chambers;

said fitting secured to said shell assembly; and said fitting extension extending into said shell assembly and forming a refrigerant vapor seal to said housing element of said compressor.

2. A compressor as recited in claim 1 wherein said refrigerant vapor seal comprises an interference fit between said fitting extension and said housing element.

3. A compressor as recited in claim 1 wherein said compressor comprises a scroll compressor and said housing element comprises a non-orbiting scroll.

4. A compressor as recited in claim 1 wherein said fitting comprises an economizer fitting and said shell assembly comprises a center shell assembly;

said economizer fitting including a first surface, a portion of said first surface flush against said center shell assembly.

5. A compressor as recited in claim 4 wherein said fitting extension comprises an economizer fitting extension, said economizer fitting extension including a raised band, said raised band adjacent said first surface and forming an approximately ninety degree angle with said first surface.

6. A compressor as recited in claim 5 further including a gap between said raised band of said economizer fitting extension and said center shell assembly.

7. A compressor as recited in claim 1 wherein said fitting includes a raised band having a set of threads.

8. A compressor as recited in claim 1 wherein said fitting extension includes a first beveled end and a second beveled end.

9. A compressor as recited in claim 1 wherein said fitting is secured to said shell assembly by a welded joint.

10. A compressor as recited in claim 1 wherein said fitting is connected to said fitting extension by an interference fit.

11. A compressor comprising:

a sealed scroll compressor having a shell assembly and a non-orbiting scroll;

a tube assembly including a fitting connected to a fitting extension, each of said fitting and said fitting extension having an interior chamber;

said interior chambers in communication with each other, such that a fluid flowing into one of said chambers can pass into the other of said chambers;

said fitting secured to said shell assembly; and said fitting extension extending into said shell assembly and forming a refrigerant vapor seal to said non-orbiting scroll.

12. A compressor as recited in claim 11 wherein said refrigerant vapor seal comprises an interference fit between said fitting extension and said non-orbiting scroll.

13. A compressor as recited in claim 11 wherein said fitting includes a first surface, a portion of said first surface flush against said shell assembly.

14. A compressor as recited in claim 13 wherein said fitting extension includes a raised band, said raised band adjacent said first surface and forming an approximately ninety degree angle with said first surface.

15. A compressor as recited in claim 14 further including a gap between said raised band of said fitting extension and said shell assembly.

16. A compressor as recited in claim 11 wherein said fitting is connected to said fitting extension by an interference fit.

17. A compressor as recited in claim 11 wherein said fitting is secured to said shell assembly by a welded joint.

18. A compressor as recited in claim 11 wherein said fitting extension includes a first beveled end and a second beveled end.

* * * * *